US008178807B2

(12) United States Patent
Aichele et al.

(10) Patent No.: US 8,178,807 B2
(45) Date of Patent: May 15, 2012

(54) ELECTRICAL SWITCH

(75) Inventors: Immanuel Aichele, Steinenbronn (DE); Thomas Kugler, Tuttlingen (DE); Heinrich Müller, Tuttlingen (DE)

(73) Assignee: Marquardt GmbH, Rietheim-Weilheim (DE)

( * ) Notice: Subject to any disclaimer, the term of this patent is extended or adjusted under 35 U.S.C. 154(b) by 262 days.

(21) Appl. No.: 12/432,043

(22) Filed: Apr. 29, 2009

(65) Prior Publication Data

US 2009/0272637 A1 Nov. 5, 2009

(30) Foreign Application Priority Data

Apr. 30, 2008 (DE) ..... 10 2008 021 509

(51) Int. Cl.
*H01H 5/06* (2006.01)

(52) U.S. Cl. ..... 200/462

(58) Field of Classification Search ..... 439/461–467, 439/DIG. 42

See application file for complete search history.

(56) References Cited

U.S. PATENT DOCUMENTS

| | | | | | |
|---|---|---|---|---|---|
| 3,995,129 | A | * | 11/1976 | Michalski | 200/462 |
| 4,532,393 | A | * | 7/1985 | Koizumi et al. | 200/343 |
| 4,673,778 | A | * | 6/1987 | Lewandowski et al. | 200/467 |
| 5,453,590 | A | * | 9/1995 | Mayer | 200/461 |
| 5,712,611 | A | | 1/1998 | Mattes et al. | |
| 5,871,087 | A | * | 2/1999 | Su | 200/462 |
| 6,717,084 | B1 | * | 4/2004 | Lu | 200/462 |
| 7,205,496 | B2 | * | 4/2007 | Schober et al. | 200/329 |

FOREIGN PATENT DOCUMENTS

| | | |
|---|---|---|
| CH | 603 003 | 8/1978 |
| DE | 7016357 | 4/1970 |
| DE | 44 21 275 | 1/1995 |
| DE | 195 12 277 A1 | 10/1995 |
| DE | 195 40 536 | 5/1997 |
| FR | 2 666 926 | 3/1992 |
| GB | 1 312 840 | 4/1973 |

* cited by examiner

*Primary Examiner* — Xuong Chung Trans
(74) *Attorney, Agent, or Firm* — Burr & Brown

(57) ABSTRACT

The invention relates to an electrical switch, in particular in the form of a microswitch and/or snap-action switch, having a housing which comprises a base and a cover. The switch has a contact system, which comprises a movable switching contact and at least one stationary contact. Furthermore, the switch has a moving operating member for switching of the contact system. The cover is mounted on the base such that it can move, and the operating member is formed by the cover.

24 Claims, 6 Drawing Sheets

ELECTRICAL SWITCH

This application claims the benefit under 35 USC §119 (a)-(d) of German Application No. 10 2008 021 509.0 filed Apr. 30, 2008, the entirety of which is incorporated herein by reference.

FIELD OF THE INVENTION

The invention relates to an electrical switch.

BACKGROUND OF THE INVENTION

Switches in the form of a microswitch and/or a snap-action switch can be used in a wide range of different applications. For example, these switches can be used for various applications in motor vehicles.

DE 195 12 277 A1 discloses an electrical switch in the form of a snap-action switch. The switch has a housing which comprises a base and a cover, and in which a contact system is located. The contact system comprises a movable switching contact and at least one stationary contact, with the electrical connections for the contact system extending out of the housing on the base. A moving operating member projects out of the housing from an opening in the cover, in order to switch the contact system. An elastic element interacts with the operating member for resetting. In order to prevent hazardous substances from entering the housing interior, the opening is sealed in a complex manner in the area of the operating member. Furthermore, it has been found that, during operation of the switch, it is possible for the switching contact to become stuck to the stationary contact, and/or to become welded to it. In a situation such as this in which a pair of contacts are stuck and/or welded together, the switch is no longer serviceable.

SUMMARY OF THE INVENTION

The invention is based on the object of further developing the electrical switch such that the seal for the housing is simplified. In particular, that surface of the housing which is opposite the connections should be completely free of interfaces that need to be sealed, that is to say for example there should be no need for a seal for the push button, a seal for the housing, or the like. In particular, the electrical switch is intended to be further developed such that the switch is still serviceable even when a pair of contacts are stuck and/or welded together.

In the case of the switch according to the invention, the cover is mounted on the base such that it can move, and the operating member is formed by the cover. This therefore results in an electrical switch in which there is no need for an opening in the housing for the operating member. This avoids the seal in the area of the operating member, contributing to simplification and cost-effectiveness of the switch. The switch is nevertheless largely protected against water and/or dust.

In one embodiment, the cover is used for covering the contact system. For this purpose, the cover is expediently mounted on the base with a rotational degree of freedom in mounting holes, to be precise at least one mounting hole. A latching hook system and/or a shaft which engage/engages in the mounting holes is used to mount the cover easily on the base.

In one refinement, a first plunger is arranged on the cover, which is used as the operating member, for the switching action on the contact system. In order to also increase the functionality of the switch, a second plunger in the form of a positive disconnector for the contact system is arranged on the cover. In its positively disconnecting function, the second plunger, in the case of a mechanical connection of the stationary contact and switching contact, applies a direct force to the movable switching contact of the contact system during movement of the cover. A switching contact which has become welded to the stationary contact is therefore positively released, during movement of the cover, in order to switch the contact system.

The contact system is expediently mounted on the base, with the electrical connections for the contact system projecting out of the housing on the base, to be precise on the side facing away from the cover. In the case of a snap-action switch, the contact system is designed in the form of a snap-action contact system with a spring element, to be precise in particular a tension spring, and a contact tongue as the switching contact. In a miniaturized form, the first plunger acts on the spring element to initiate the switching process of the contact system. In a compact arrangement, the second plunger likewise acts directly on the contact tongue for positive disconnection of the switching contact from the stationary contact.

In order to provide a complete covering system for the contact system against the ingress of hazardous substances, the cover is designed to clasp the base in the form of a sleeve. A raised area, whose shape is largely free and which can be matched to the respective purpose of the switch, is arranged in a simple manner on the outside of the cover, as the operating member which carries out the function of a push button. The cover which is opposite the connections and is used as a housing upper part therefore advantageously carries out the functions of the push button, the positive disconnector, and a seal for the individual parts of the contact system, as a result of which the cover represents a cost-effective multifunction part.

In order to allow it to be manufactured easily, the cover comprises a plastic part. The first plunger is integrated in one piece in the plastic part in a simple manner in order to act on the contact system. The second plunger can likewise be integrated in one piece in the plastic part in a simple manner. Furthermore, the first plunger and the second plunger can be arranged in the form of attachments in the interior of the sleeve-like cover, alongside one another in the extent direction of the contact system. The cover can then be produced in a cost-effective manner by the injection-molding process, with the two plungers also being molded at the same time in the interior of the sleeve-like cover.

In summary, the following statements can be made for one particularly preferred embodiment. The housing upper part, which is normally opposite the connections, of a snap-action switch as well as the push button, the positive disconnector and a seal which might be present are dispensed with as individual parts. The switching system is covered by a plastic part which is mounted with a rotational degree of freedom in the mounting holes. The assembly process is carried out by means of a latching hook system or a shaft which engages in the described mounting holes. A plunger is integrated in the plastic part which acts on the spring element of the snap-action contact system and thus initiates the switching process. With its positively disconnecting function, a second plunger applies a direct force to the moving contact mount only when the stationary contact and tongue contact are mechanically connected.

The function of the push button is carried out by a raised area, whose design is largely free, on the outside of the sleeve. Material and cost savings are achieved by the combination of the encapsulation function of the housing against environmental influences and the mechanical function of the push button. In particular, this results in compliance with ingress-protection class IP40 for the switching system of a snap-action switch, while at the same time saving components by virtue of the design of a moving operating part, which combines the function of the cover, the seal, the operating member, and the positive disconnection.

The advantages achieved by the invention in particular comprise a cost saving resulting from the high level of integration of different functions in the cover. As a result of the lack of sealing points, the surface of the housing is essentially closed and is largely without the previous interfaces, such as the seal for the push button and the seal housing, which include a failure potential. This furthermore results in complete encapsulation of the housing against greases and substances used during operation on the upper face of the switch. In consequence, the switch according to the invention achieves a high degree of sealing against dust and/or water, in particular allowing the switch to comply with ingress-protection class IP40.

BRIEF DESCRIPTION OF THE DRAWINGS

One exemplary embodiment of the invention, together with various developments and refinements, is illustrated in the drawings and will be described in more detail in the following text.

DETAILED DESCRIPTION OF THE INVENTION

Figure 1:
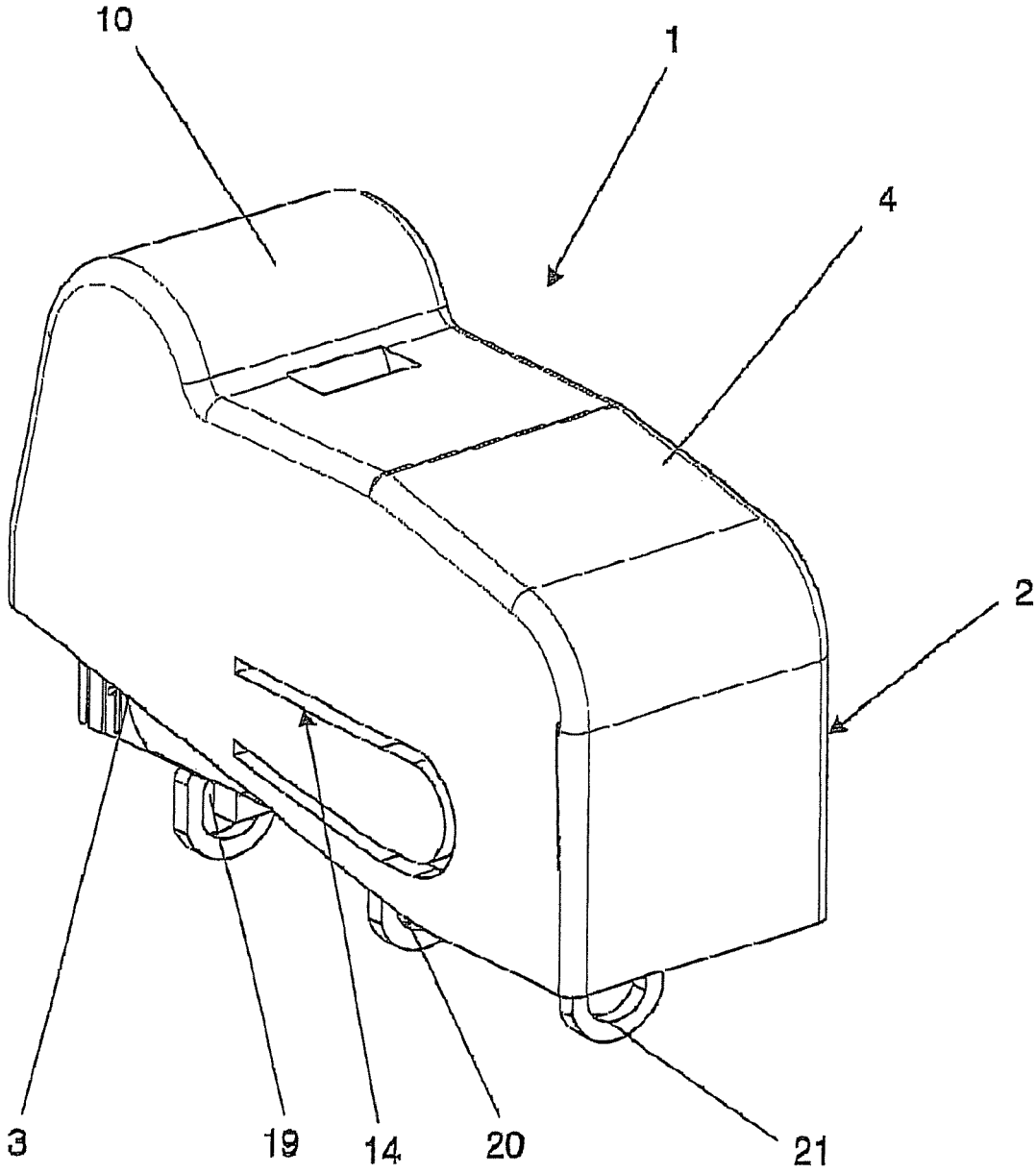
FIG. 1 shows a perspective view of an electrical switch.
Figure 3:
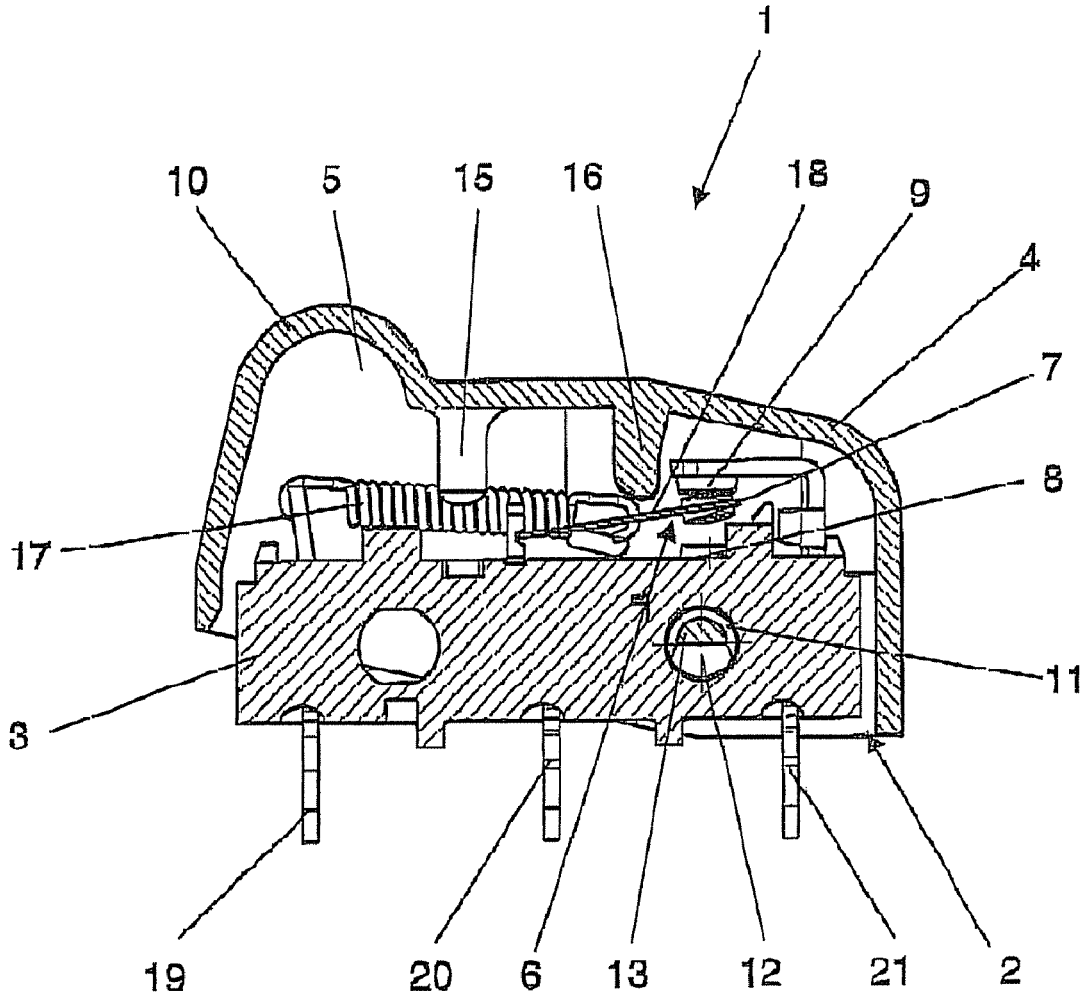
FIG. 3 shows a longitudinal section through the switch of FIG. 1.
Figure 5:
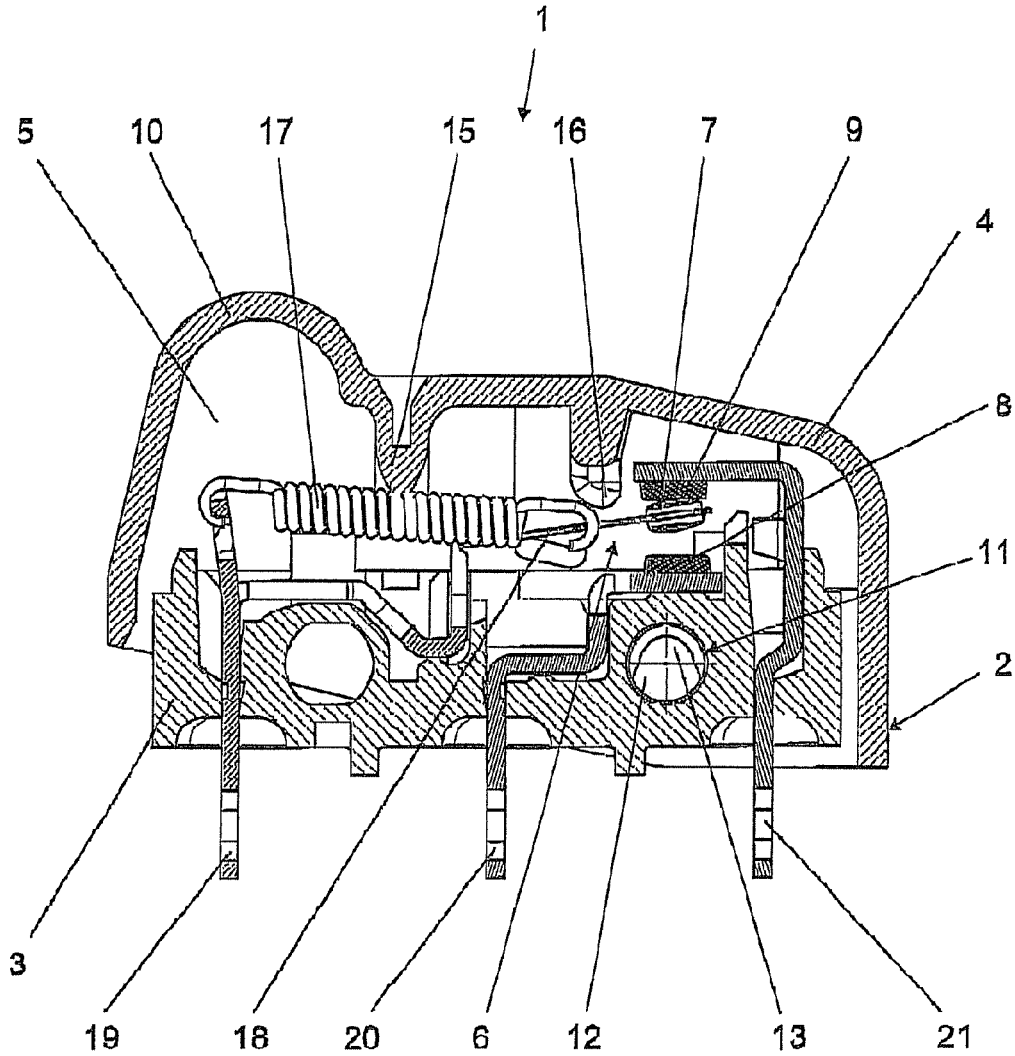
FIG. 5 shows a further section through the switch, with the switch in an inactivated state.
Figure 6:
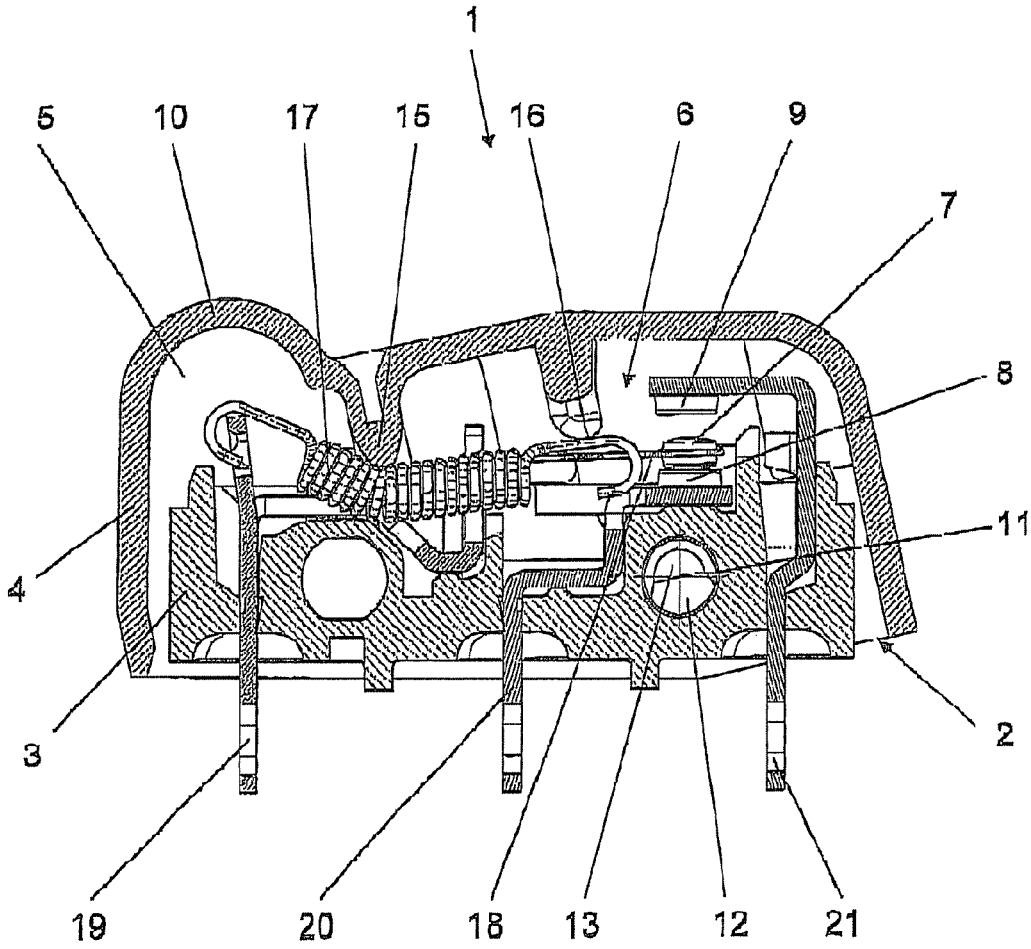
FIG. 6 shows a section as in FIG. 5, but with the switch in an activated state.

FIG. 1 shows an electrical switch 1 which is in the form of a microswitch and/or snap-action switch. The switch 1 has a housing 2 which comprises a base 3 and a cover 4. As can be seen from FIG. 5, a contact system 6, which comprises a movable switching contact 7 and at least one stationary contact 8, is arranged in the interior 5 of the housing 2. In the present case, the contact system 6 also has a further stationary contact 9, such that the switching contact 7 switches between the stationary contact 9 as shown in FIG. 5 and the stationary contact 8 as shown in FIG. 6. A movable operating member 10, which is integrated in the cover 4, is used to switch the contact system 6, such that the operating member 10 is formed by the cover 4, as shown in FIG. 3. In order to operate the operating member 10, the cover 4 is mounted on bearing points 11 (see FIG. 3) on the base 3 such that it can move. A spring element 17 interacts with the operating member 10 or with the cover 4 in order to reset the cover 4 from the operated position as shown in FIG. 6 to the rest position as shown in FIG. 5.

Figure 2:
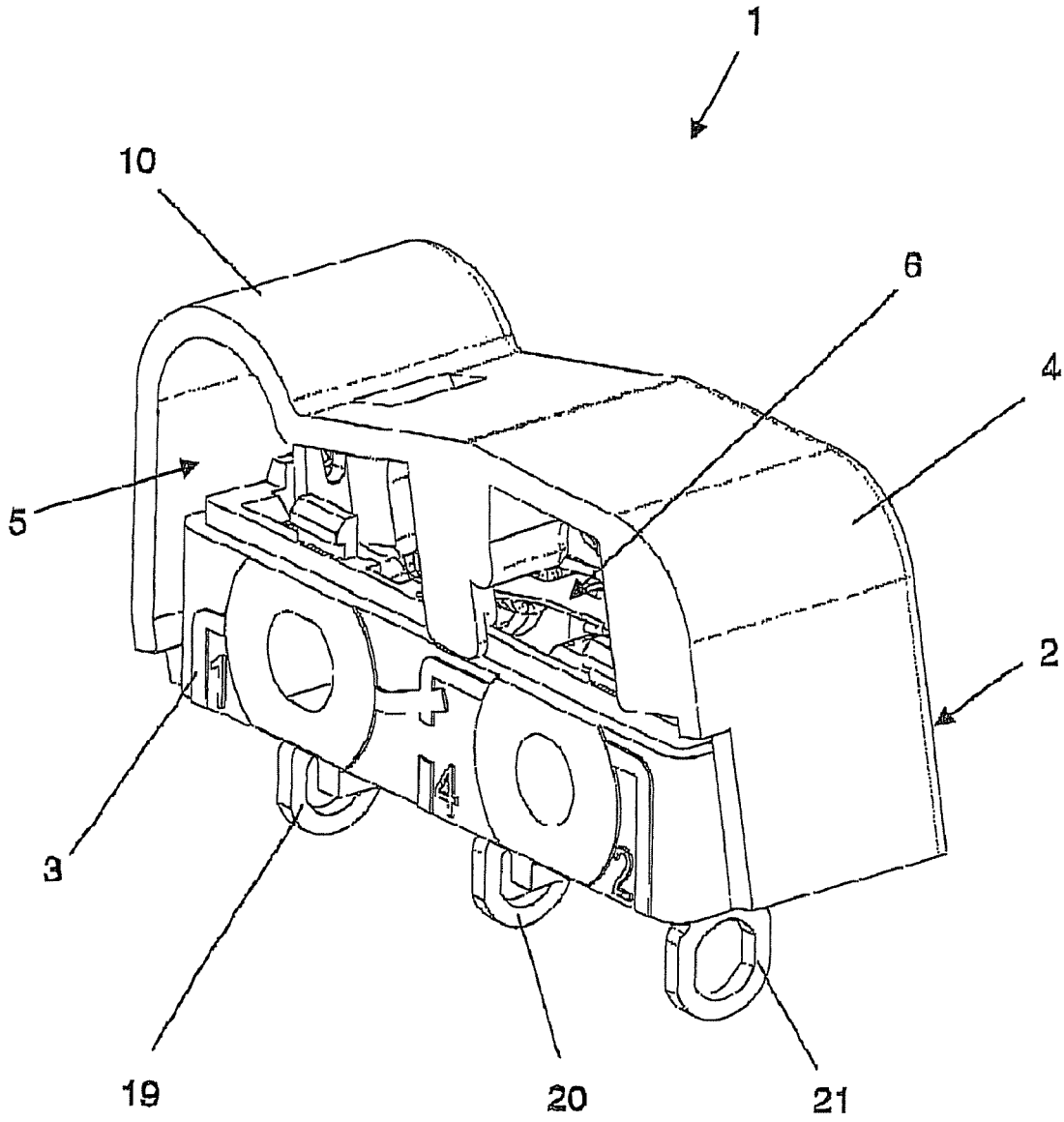
FIG. 2 shows the switch from FIG. 1 with the cover cut open.

As can be seen from FIG. 2, the cover 4 is used for covering the contact system 6. In order to allow the movement of the cover 4 for switching the contact system 6, the cover 4 is mounted on the base 3 with a rotational degree of freedom in mounting holes 12, as can be seen in FIG. 5. The cover 4 is mounted on the base 3 by means of an elastic element 14 in the form of a latching hook system (see FIG. 4), which is not shown in any more detail, and/or a shaft 13, which engages in the mounting holes 12. The shaft 13 and the mounting hole 12 therefore form the bearing point 11. The operating member 10 takes the form of a raised area, whose shape is largely free as shown in FIG. 2, arranged on the outside of the cover 4 and carries out the function of the push button. The shape of the raised area defining the operating member 10 can be appropriately matched to the respective type of operation for the switch 1.

Figure 4:
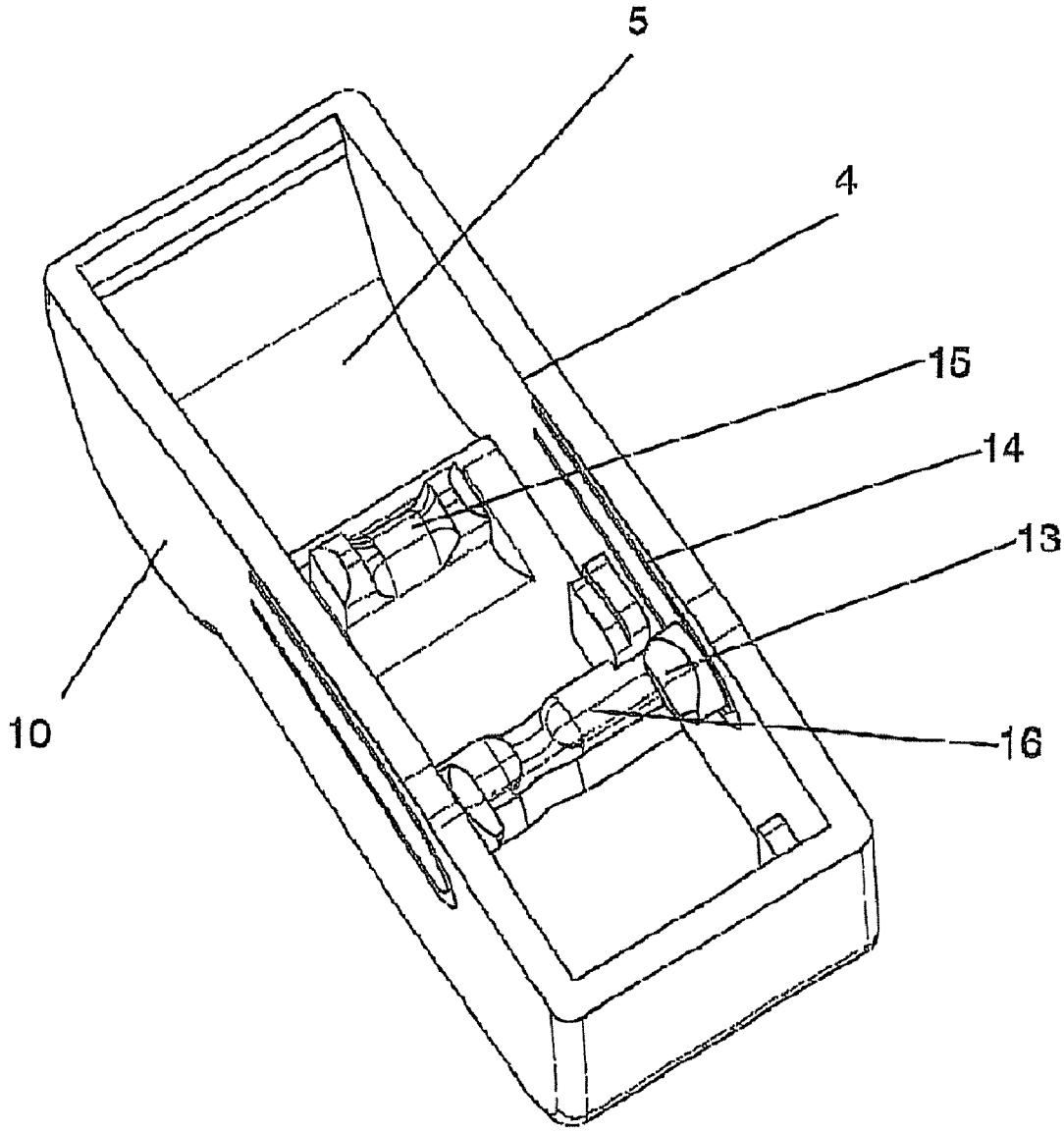
FIG. 4 shows the inside of the cover of the switch.

As shown in FIG. 4, the cover 4 comprises an integral plastic part which is produced by injection molding. A first plunger 15 is integrated in one piece in the plastic part 4 for the switching action on the contact system 6 when the operating member 10 is moved appropriately. As already mentioned, the contact system 6 is the form of a snap-action contact system and, as shown in FIG. 5, has a spring element 17, which comprises a tension spring, and a contact tongue 18 as the switching contact 7. The first plunger 15 acts on the spring element 17 to initiate the switching process on operation of the cover 4, as can be seen by comparison of FIG. 5 and FIG. 6.

As shown in FIG. 4, a second plunger 16 is integrated in one piece in the plastic part 4 and acts in the form of a positive disconnector. As can be seen from FIG. 5, the second plunger 16 acts directly on the contact tongue 18 to positively release the switching contact 7 on operation of the cover 4 if the switching contact 7 becomes welded to the stationary contact 9. In its positively disconnecting function in the event of a mechanical connection of a stationary contact 9 and a switching contact 7, the second plunger 16 therefore applies a direct force to the movable switching contact 7.

The contact system 6 is mounted on the base 3. As shown in FIG. 3, electrical connections 19, 20, 21 for the contact system 6 project out of the housing 2 on the base 3, on the side facing away from the cover 4. The electrical connections 19, 20, 21, which are produced in the form of stamped and bent parts from metal, are used to supply the electrical voltage to the contact system 6. In this case, as shown in FIG. 5, the stationary contact 8 is arranged in the interior 5 of the housing 2 and is connected to the connection 20, and the stationary contact 9 is arranged in the interior 5 of the housing 2 and is connected to the connection 21. The contact tongue 18 is mounted such that it can move from a blade-type bearing at the connection 19. In the interior 5 of the housing 2, the connection 19 has an eye in which one end of the tension spring 17 is hooked. The other end of the tension spring 17 is in turn hooked into the contact tongue 18. As can be seen from FIG. 2, the cover 4 clasps the base 3 in the form of a sleeve. The first plunger 15 and the second plunger 16 are arranged in the form of attachments in the interior 5 of the sleeve-like cover 4, to be precise alongside one another in the extent direction of the contact system 6, as can be seen in FIG. 3. As shown in FIG. 1, the elastic element 14 for latching of the cover 4 is in the form of a spring clip, with in each case one spring clip 14 being arranged on both sides of the cover 4, in order to ensure that the latching force is exerted symmetrically. The cover 4, which is opposite the connections 19, 20, 21 and is used as the housing upper part, therefore carries out the functions of the push button for switching the contact system 6, a positive disconnector for a welded switching contact 7, and a seal for the individual parts of the switch 1.

The invention is not restricted to the described and illustrated exemplary embodiment. In fact, it also covers all specialist developments within the scope of the invention as defined by the claims. For example, the described housing 2 with an integrated operating member 10 can advantageously be used not only for snap-action switches and/or microswitches but also for other electrical switches, for example for appliance switches. The switch 1 according to the invention can advantageously be used not only in motor vehicles but also in electrical appliances, machines or the like.

LIST OF REFERENCE SYMBOLS

1: (electrical) switch
2: housing
3: base
4: cover/plastic part
5: interior (of the housing)
6: contact system
7: switching contact
8, 9: stationary contact
10: operating member/raised area
11: bearing point
12: mounting hole
13: shaft
14: elastic element/spring clip
15: (first) plunger
16: (second) plunger
17: spring element/tension spring
18: contact tongue
19, 20, 21: (electrical) connection

What is claimed:

1. An electrical switch, in particular in the form of a microswitch and/or snap-action switch, having a housing which comprises a base and a cover, having a contact system, which comprises a movable switching contact and at least one stationary contact, the cover having a first operating member for switching of the contact system and a second operating member for applying a direct force to the movable switching contact, both operating members being moved by movement of the cover, and said electrical switch further having a spring element which interacts with the first operating member for switching the switching contact system, wherein the cover is mounted on the base such that the cover can move the switching contact, and wherein the entirety of the first operating member and the entirety of the second operating member are integrally formed as parts of the cover.

2. The electrical switch as claimed in claim 1, wherein the cover is used for covering the contact system, the cover is mounted on the base with a rotational degree of freedom in at least one mounting hole and in that, furthermore, the cover is mounted on the base by means of at least one of a latching hook system which engages in the mounting hole and a shaft which engages in the mounting hole.

3. The electrical switch as claimed in claim 1, wherein the first operating member is a first plunger that is arranged inside the cover for the switching action on the contact system.

4. The electrical switch as claimed in claim 1, wherein the second operating member is a second plunger that is arranged inside the cover in the form of a positive disconnector for the contact system, wherein the second plunger positively disconnects a mechanical connection of the stationary contact and the switching contact, in order to switch the contact system.

5. The electrical switch as claimed in claim 1, wherein the contact system is mounted on the base and wherein electrical connections for the contact system project out of the housing on the base on a side of the base facing away from the cover.

6. The electrical switch as claimed in claim 1, wherein the contact system is designed in the form of a snap-action contact system with a spring element, in particular a tension spring, and a contact tongue as the switching contact, wherein the first operating member preferably acts on the spring element in order to initiate the switching process of the contact system, and wherein the second operating member acts directly on the contact tongue for positive disconnection of the switching contact from the stationary contact.

7. The electrical switch as claimed in claim 1, wherein the cover is designed to clasp the base in the form of a sleeve, wherein a raised area is arranged on the outside of the cover as a raised operating member which carries out the function of a push button, and wherein a spring clip interacts with the cover and the base as an elastic element for resetting the cover, the outside of the cover is opposite the connections and used as a housing upper part and carries out the functions of the push button, of the positive disconnector and of a seal for the individual parts of the contact system.

8. The electrical switch as claimed in claim 1, wherein the cover comprises a plastic part, wherein the first operating member is integrated in the plastic part, and wherein the second operating member is also integrated in the plastic part, wherein the plastic part is one piece.

9. The electrical switch as claimed in claim 1, wherein the first operating member and the second operating member are arranged in the form of attachments in the interior of the sleeve-like cover, wherein the first operating member and the second operating member are alongside one another in the extension direction of the contact system.

10. An electrical switch comprising:

a housing that includes a base and a cover mounted on said base in a movable manner, at least a first integral portion of said cover defining a first operating member and at least a second integral portion of said cover defining a second operating member for activating the switch between at least two positions, wherein the entirety of the first operating member and the entirety of the second operating member are both integrally formed along an internal contour of the cover; and a contact system arranged within said housing and comprising a moveable switching contact and at least one stationary contact, wherein said contacts are spaced from one another in one of said at least two positions and contact one another in the other one of said at least two positions.

11. The electrical switch as claimed in claim 10, wherein said cover is mounted in at least one mounting hole on said base with a rotational degree of freedom.

12. The electrical switch as claimed in claim 11, wherein said cover is mounted on said base by a latching hook system which engages in the mounting hole.

13. The electrical switch as claimed in claim 12, wherein said latching hook system comprises a shaft that engages in the mounting hole.

14. The electrical switch as claimed in claim 10, wherein said second operating member is a positive disconnector for said contact system, such that said second operating member, in the case of a mechanical connection of said stationary contact and said switching contact, applies a direct force to said movable switching contact during movement of the cover in order to switch said contact system.

15. The electrical switch as claimed in claim 14, wherein said second operating member acts directly on said contact tongue for positive disconnection of said switching contact from said stationary contact.

16. The electrical switch as claimed in claim 10, wherein said contact system is mounted on said base and said electrical switch further comprises electrical connections for said contact system that project out of said housing on a side facing away from said cover.

17. The electrical switch as claimed in claim 10, wherein said contact system is a snap-action contact system comprising a tension spring element and a contact tongue as the movable switching contact, wherein said first operating member acts on said tension spring element to initiate switching of said contact system and said second operating member acts directly on said contact tongue for positive disconnection of said switching contact from said stationary contact.

18. The electrical switch as claimed in claim 10, wherein said cover is dimensioned so as to clasp said base in the form of a sleeve.

19. The electrical switch of claim 10, wherein a raised operating member takes the form of a raised area on the outside of said cover so as to function as a push button.

20. The electrical switch as claimed in claim 19, wherein said cover simultaneously carries out the functions of (i) a push button for the electrical switch, (ii) a positive disconnector for said contact system, and (iii) a seal for individual parts of said contact system.

21. The electrical switch as claimed in claim 10, wherein said second operating member is a positive disconnector for said contact system, such that said second operating member, in the case of a mechanical connection of said stationary contact and said switching contact, applies a direct force to said movable switching contact during movement of the cover in order to switch said contact system.

22. The electrical switch as claimed in claim 21, wherein said cover comprises a plastic part, wherein said first operating member is integrated in one area of the plastic part, and said second operating member is integrated in another area of the plastic part.

23. The electrical switch as claimed in claim 22, wherein said first operating member and said second operating member are arranged alongside one another in a longitudinal extension direction of said contact system.

24. The electrical switch as claimed in claim 23, wherein said first operating member and said second operating member are arranged as attachments in the interior of said cover.

* * * * *